US008550735B2

(12) United States Patent
Rolion et al.

(10) Patent No.: US 8,550,735 B2
(45) Date of Patent: Oct. 8, 2013

(54) WRITING INSTRUMENT WITH CUSHIONING DEVICE

(75) Inventors: Franck Rolion, Asnieres sur Oise (FR); Richard C. O'Brien, Oxford, CT (US); Bertrand Baudouin, Paris (FR)

(73) Assignee: Societe Bic, Clichy (FR)

( * ) Notice: Subject to any disclaimer, the term of this patent is extended or adjusted under 35 U.S.C. 154(b) by 815 days.

(21) Appl. No.: 12/307,822

(22) PCT Filed: Jul. 7, 2006

(86) PCT No.: PCT/IB2006/003341

§ 371 (c)(1),
(2), (4) Date: Jul. 6, 2009

(87) PCT Pub. No.: WO2008/007167

PCT Pub. Date: Jan. 17, 2008

(65) Prior Publication Data

US 2009/0290929 A1 Nov. 26, 2009

(51) Int. Cl.
*B43K 7/12* (2006.01)

(52) U.S. Cl.
USPC ..... 401/103; 401/54; 401/99; 401/109; 401/110

(58) Field of Classification Search
USPC ..... 401/54, 99–117, 259–260
See application file for complete search history.

(56) References Cited

U.S. PATENT DOCUMENTS

| | | | | | |
|---|---|---|---|---|---|
| RE23,256 | E | * | 8/1950 | Engel, Jr. | 401/54 |
| 3,051,132 | A | * | 8/1962 | Johmann | 401/103 |
| 3,232,278 | A | * | 2/1966 | Johmann | 401/103 |
| 3,273,541 | A | | 9/1966 | Thurman et al. | |
| 3,298,357 | A | | 1/1967 | Bross | |
| 3,419,336 | A | * | 12/1968 | Kirk | 401/111 |
| 4,991,988 | A | | 2/1991 | Snell et al. | |
| 7,137,751 | B2 | * | 11/2006 | Candelora et al. | 401/103 |
| 7,959,368 | B2 | * | 6/2011 | Sheu | 401/103 |
| 2004/0234322 | A1 | | 11/2004 | Candelora et al. | |

FOREIGN PATENT DOCUMENTS

| | | |
|---|---|---|
| DE | 41 00 842 C1 | 5/1992 |
| GB | 2 129 741 A | 5/1984 |
| GB | 2 130 530 | 6/1984 |

* cited by examiner

*Primary Examiner* — David Walczak
*Assistant Examiner* — Bradley Oliver
(74) *Attorney, Agent, or Firm* — Jones Day

(57) ABSTRACT

A retractable writing instrument that includes a barrel, a writing tip, an actuating mechanism that includes a plurality of parts for extending and retracting the writing tip upon actuation of the actuation member, and a cushioning device enabling a retraction of the writing tip when an excessive pressure is exerted by a user. The cushioning device includes a spring member elastically deformable, which is integrally formed with a movable part of the actuating mechanism, the part being movable relative to the barrel. The spring member has a free end abutting the barrel toward its rear end and has a through hole. A stem extends within the spring member's hole and connects the actuating member to the actuating mechanism.

15 Claims, 6 Drawing Sheets

WRITING INSTRUMENT WITH CUSHIONING DEVICE

CROSS-REFERENCE TO RELATED APPLICATIONS

This application is a national stage application of International Application No. PCT/IB2006/003341, filed on Jul. 7, 2006, the entire contents of the application being incorporated herein by reference.

BACKGROUND OF THE EMBODIMENTS OF THE INVENTION

The embodiments of the present invention relate to a writing instrument with a retractable writing tip and a cushioning device enabling retraction of the writing tip when an excessive pressure is exerted thereon by a user. More particularly, the embodiments of the present invention relate to a writing instrument comprising:

a barrel extending along a central axis between a front end and a rear end provided with a front and a rear apertures respectively;

a writing tip movable through the front aperture between an extended position and a retracted position for which said writing tip is situated within said barrel;

an actuating mechanism comprising a plurality of parts for extending and retracting the writing tip upon actuation of an actuation member; and a cushioning device.

DESCRIPTION OF RELATED ART

The use of a cushioning device improves the writing comfort for the user and could avoid damages to the paper sheet or to the writing tip. It could be used for various kinds of writing instruments, and notably for ballpoint pens, fibrous pens or mechanical pencils. In the particular case of a mechanical pencil, the cushioning device reduces the risk of breaking the lead when the user exercises a high pressure on the paper sheet. Various embodiments of a cushioning device are known, for example from the document US-A-2004/0234322. However, the writing instruments on the market having a cushioning device belong to the type of non-retractable writing instruments, i.e. instruments in which the writing tip cannot be retracted within the barrel when not in use. Thus, most of these instruments are provided with a removable cap to be fitted on the front end of the barrel in order to avoid the marking of stains and/or the drying-out of the tip. In fact, the provision of an actuating mechanism for retracting/extending the tip together with a cushioning device within the barrel raise some issues.

SUMMARY OF THE EMBODIMENTS OF THE INVENTION

One raised issue is the complexity of such a writing instrument which increases considerably the manufacturing process and the cost. There is also an issue about the remaining space within the barrel for receiving an ink cartridge, mostly if the lifetime of the writing instrument should not be reduced excessively.

Thus, there remains a need for retractable tip writing instrument with a cushioning device that can be produced in industrial quantities at an acceptable price. According to one aspect of the invention for avoiding these drawbacks, there is provided a writing instrument of the above-mentioned type, wherein said cushioning device comprises a spring member elastically deformable in said central axis direction, which is integrally formed with a movable part of said actuating mechanism, said part being movable relative to said barrel along said central axis, wherein said spring member has a free end abutting said barrel toward its rear end and has a through hole extending along said central axis;

and wherein a stem, extending within said hole of said spring member, connects said actuating member to said actuating mechanism.

The provision of the spring member integrally formed with a part of the actuating mechanism reduce the number of parts of the writing instrument. That reduces the cost and mostly facilitates the assembly of the mechanism with the cushioning device. These provisions also save space within the barrel for the ink cartridge since the spring member is located near the rear end of the barrel, is immediately adjacent to the actuating mechanism, and defines a through hole in which some parts of the mechanism are arranged.

According to another aspect of the invention, that may be independent of the above-mentioned aspect, the spring member is designed to prevent transmission of torque around said central axis to said movable part of the actuation mechanism when said spring member is compressed in the direction of said central axis. In fact, with a spring member having a helical shape, a little rotation of one end could occur when that type of spring member is compressed. This has no real drawback with non-retractable writing instruments such as described in US-A-2004/0234322. However, with the retractable instrument comprising parts guided precisely along a longitudinal direction by cooperation of grooves and ribs, it has been found that frictional forces could appear between the mechanism and the barrel, if the spring member creates a torque.

Various embodiments of a spring member which does not transmit any torque could be designed. However, preferred embodiments of the invention have one or more of the following features:

- the spring member comprises at least one wavy portion extending globally in the direction of said central axis and having at least a first and a second curve distributed on both sides of its extension axis;
- the wavy portion has an odd number of curves regularly distributed on both sides of its extension axis;
- at least a first and a second wavy portion are provided, said first and second wavy portion being circumferentially arcuated around said central axis to at least partially define said through hole of the spring member;
- the first and second wavy portion are linked together by the middle section of two adjacent curves belonging respectively to said first and second wavy portion;
- the at least one wavy portion is terminated by a ring at the free end side of the spring member.

Various types of actuating mechanism are suitable for being combined with the cushioning device according to the embodiments of the invention, however the following features can be provided in preferred embodiments:

- the movable part integrally formed with said spring member is tubular and has a central axis collinear with the through hole of said spring member;
- the cushioning device further comprises an additional spring member formed by a metallic helical spring provided between said movable part of the mechanism and said barrel;

the spring rate characteristics of said additional helical spring are different from the spring rate characteristics of said spring member;

the additional helical spring is fitted on said movable part of the actuating mechanism;

the movable part has at least one cam path cooperating with a rotative part of the actuation mechanism;

the actuating mechanism is a ratchet-plunger type mechanism actuated by a rear knock button.

BRIEF DESCRIPTION OF THE DRAWINGS

Other features and advantages of the embodiments of the invention will become apparent in view of the following description of a preferred embodiment, which is given by way of non limiting example, with reference to the appended drawings, in which.

The same numeral references are used in the various figures to designate identical or similar components.

DETAILED DESCRIPTION OF THE EMBODIMENTS OF THE INVENTION

Figure 1:
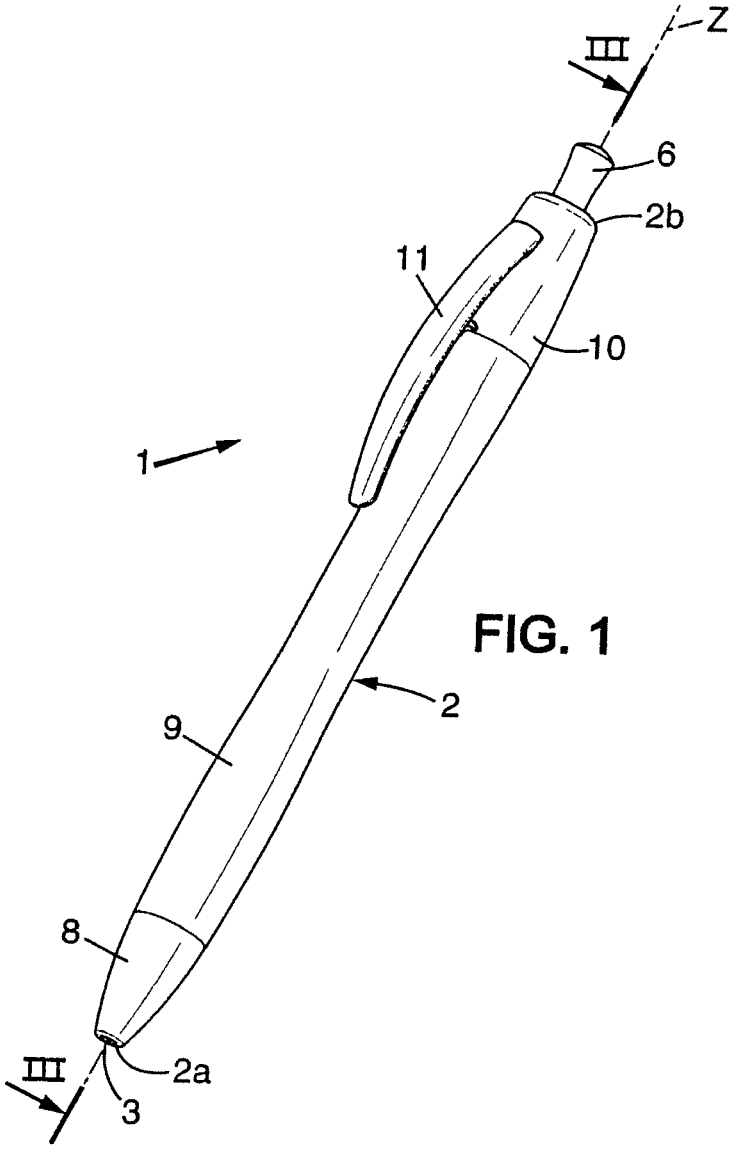
FIG. 1 is a perspective view of a retractable instrument comprising an actuation mechanism and a cushioning device according to the invention.
Figure 3:
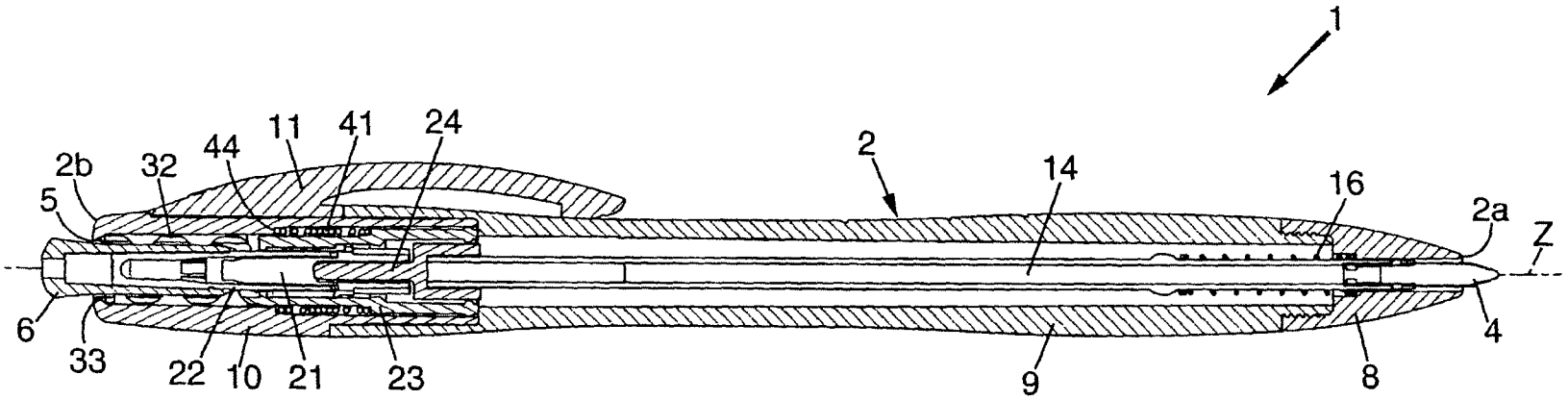
FIG. 3 is a cross-sectional view of the writing instrument of FIG. 1 along line III-III with a writing tip in an extended position.
Figure 4:
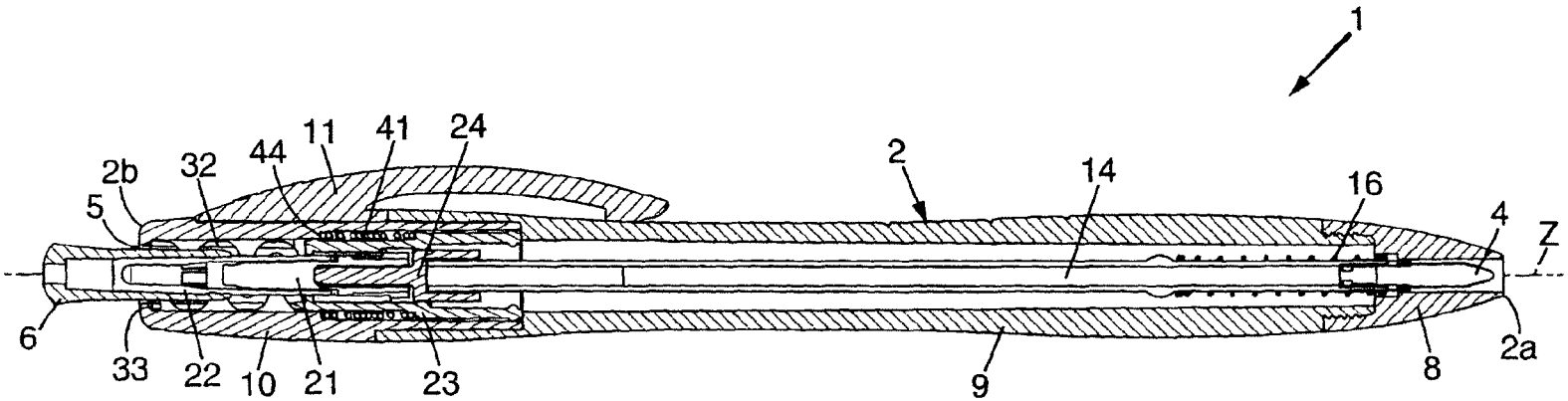
FIG. 4 is a view analogue to FIG. 3 in which the writing tip is in a retracted position.

FIG. 1 shows a preferred embodiment of a writing instrument according to the invention. The instrument 1 has a barrel 2 extending along a central axis Z from a front end 2*a* to rear end 2*b*. The front end 2*a* has a front aperture 3 through which a writing tip 4 is movable between an extended position represented on FIG. 3, and a retracted position represented in FIG. 4. The rear end 2*b* of the barrel has a rear aperture 5 through which extends a rear knock button 6.

The barrel 2 comprises, from the front to the rear ends, a nose-cone 8, an intermediate tubular member 9 and a rear tubular member 10 having a clip 11. However, the barrel can be constituted by a different number of parts.

Figure 2:
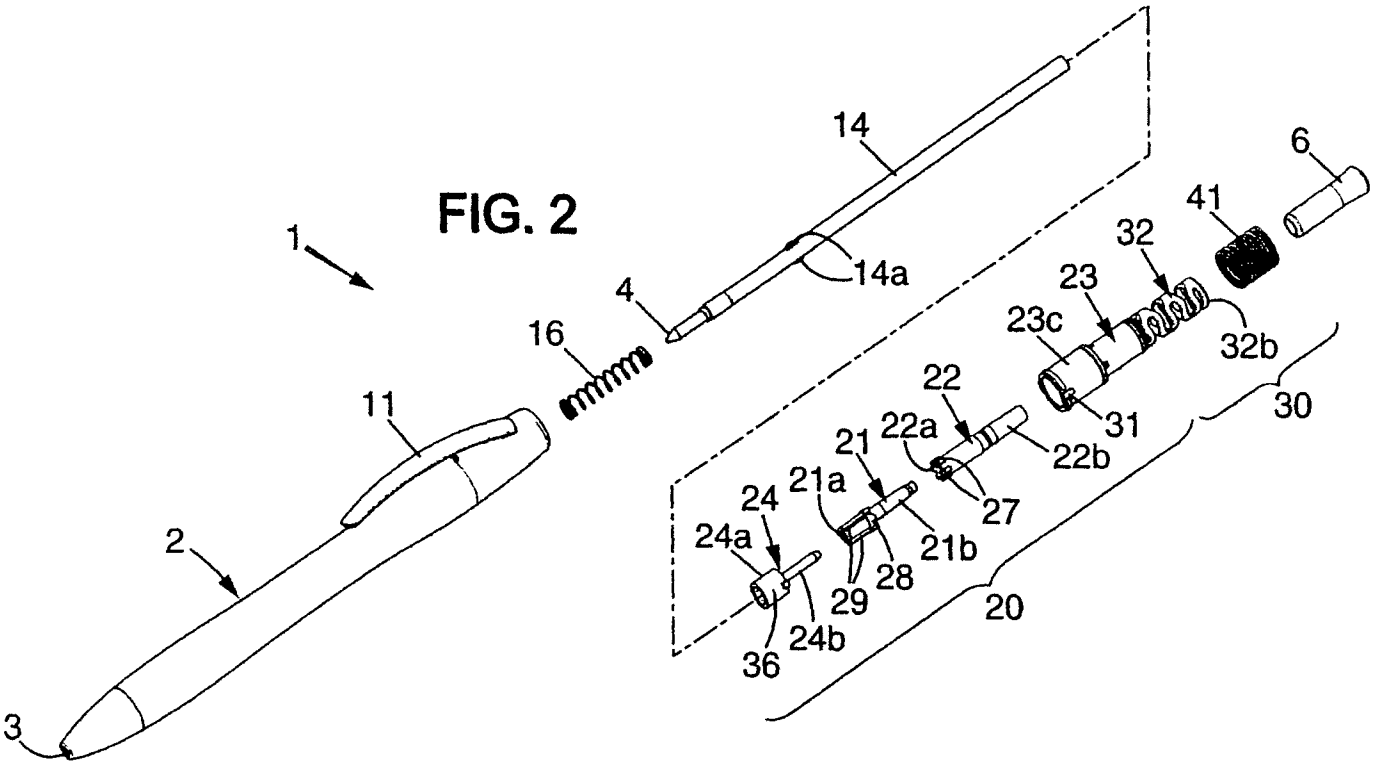
FIG. 2 is an exploded view of the writing instrument of FIG. 1.

The writing tip 4 is a ballpoint tip formed at a front end of an ink cartridge 14 visible in FIG. 2. The ink cartridge 14 has two opposite projections 14*a*. However, the invention is not limited to that kind of writing tip and could be used, for example, with a mechanical pencil cartridge having an integrated lead advance mechanism, or with a fibrous writing tip if the writing instrument is provided with a removable cap or a device for sealing the front aperture 3 in retracted position.

With reference to FIGS. 2 to 5, a biasing member 16 is arranged between the front end 2*a* and projections 14*a* of the ink cartridge 14 to elastically bias the cartridge toward the rear end 2*b*. An actuation mechanism 20 and a cushioning device 30 are also provided within the barrel 2.

The actuation mechanism 20 enables the writing tip 4 to extend or retract when a user activates an actuation member formed by the rear knock button 6 in the represented embodiment. The function of the cushioning device 30 is to absorb an 5 excessive pressure exerted on the writing tip 4 by the user. The cushioning device must enable a little rearward displacement of the writing tip if the pressure exerted thereon is excessive. Generally, when the writing tip 4 moves rearward towards the retracted position the user releases the pressure exerted on the writing instrument. Then, the resiliency of the cushioning device 30 enables the return of the writing tip 4 to the extended position.

The actuating mechanism is of the ratchet-plunger type which is known per se, in particular from document U.S. Pat. No. 4,991,988. This mechanism comprises a ratchet 21, a plunger 22, a tubular part 23 and an adaptor 24.

The tubular part 23 has an annular internal surface provided with a saw-like cam path 25. The cam path 25 forms front and rear abutment portions (25*a*, 25*b*) separated by preferably six longitudinal grooves 26, as best shown on FIG. 7.

The plunger 22 has a stem portion 22*a* extending toward the rear and six radial projections 27 adjacent to the front end 22*a* which slidingly engage the grooves 26 of the tubular part 23. The front end 22*a* of the plunger 22 5 preferably has the shape of a teethed crown.

The ratchet 21 has a cylindrical projection 21*b* rotatively inserted through the front end 22*a* of the plunger 22. The ratchet 21 has also an annular shoulder 28 presenting a surface oriented toward the rear end 2*b* which is complementary to the teethed crown 22*a* of the plunger. Three longitudinal projections 29 are provided on the external surface of the ratchet 21 from the shoulder 28 to the front end 21*a*. The rear end of the longitudinal projections 29 can abut against either the front or the 5 rear portion 25*a*, 25*b* of the cam path 25, and can be guided longitudinally by the grooves 26.

The adaptor 24 has a rear pin portion 24*b* inserted within the ratchet 21, and preferably a front cup-shaped portion 24*a* against which the ink cartridge 14 abuts upon the action of the biasing member 16. However, the adaptor 24 may have conical shape with a flat end at it front end. The adaptor 24 may be mounted free to rotate in the ratchet 21 to avoid the transmission of a rotational displacement or torque between the ratchet 21 and the ink cartridge 14. However, the adaptor 24 could be fixed to the ratchet 21, and even fitted over the cartridge 14 in a manner that prevents relative rotation between them, without impeding the operation of the ratchet-plunger mechanism 20.

When the rear knock button 6 is pressed by a user, the plunger 22 moves forward relative to the tubular part 23 and cooperates with the ratchet 21 to push the longitudinal projections 29 out the grooves 26 of the tubular part 23. The teethed crown 22*a* of the plunger 22 and the complementary shoulder 28 of the ratchet 21 are designed to create a slight rotation of the ratchet 21 when the rear knock button is pressed forward. Consequently, the longitudinal projection 29 of the ratchet abut alternatively against the front and the rear portions 25*a*, 25*b* of the cam path of the tubular part 23 when the user releases the rear knock button 6.

This actuation mechanism 20 causes the movement of the writing tip 4 from the retracted position to the extended position, and reversely, upon each actuation of the rear knock button 6. The ratchet-plunger type mechanism is convenient for most users and requires little space. In particular, the external diameter of the ratchet and the plunger can be small in comparison of the barrel's diameter. Consequently, it saves enough space for accommodating the sliding tubular part 23.

The tubular part 23 preferably has an external surface 23*c* which is designed for enabling a longitudinal displacement relative to the barrel 2. Two opposite projections 31 are provided on the external surface 23*c* and cooperate with longitudinal grooves of the barrel, not shown, for preventing rotation of the tubular part 23 relative to the barrel 2.

The projections 31 of the tubular member 23 and the adaptor 24 avoid transmission of a torque to the ratchet 21. Consequently, this prevents a rotation of the ratchet 21 without actuating the rear knock button 6 and then avoids an involuntary change of position of the writing tip 4.

Figure 5:
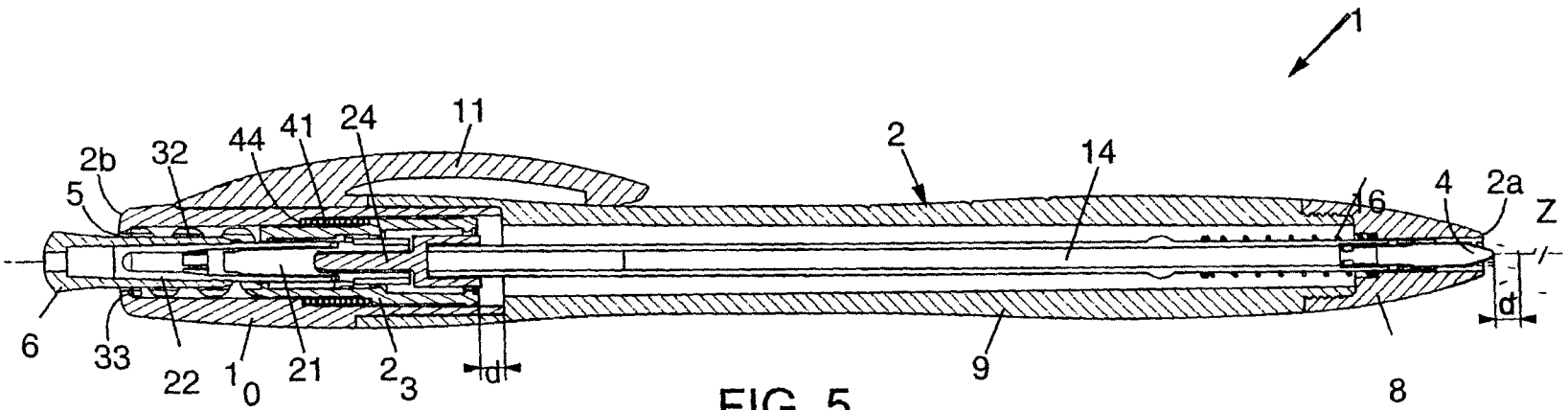
FIG. 5 is a view analogue to FIG. 3 in which the writing tip is in a cushioned position.

With reference to FIG. 5, the mobility of the tubular part 23 must enable a displacement thereof from the position corresponding to the extended position of the writing tip represented in dotted line, towards the rear end 2*b* of the barrel along a predetermined longitudinal distance d. This predetermined distance d must be long enough to obtain the cushioning effect when the writing tip moves rearward from an excessive pressure.

It should be noted that the longitudinal position of the tubular part 23 is the same for the retracted and extended positions of the writing tip 4. This simplifies the cushioning device 30 and facilitates the adjusting of the cushioning force.

The rear end 23*b* of the tubular part 23 is provided with a spring member 32 which extends towards the rear end 2*b* of the barrel 2. The spring member 32 has a free end 32*b* opposite to the tubular member 23 which abuts in the rear direction against an internal shoulder 33 of the barrel 2. The spring member 32 is resiliently compressible in the direction of the central axis Z for enabling a rearward displacement of the whole actuating mechanism 20 and consequently of the writing tip 4.

The spring member 32 is integrally formed with the tubular part 23 during an injection molding process of plastic material. This enables the manufacturing of a single piece having two functions during the same step.

The spring member 32 has a through hole 35 which is collinear to the central axis Z and approximately of the same diameter as the internal diameter of the tubular part 23. The through hole 35 provides a passage for connecting the rear knock button 6 forming the actuation member of the mechanism and the ratchet-plunger mechanism 20 itself. This provision enables to save space within the barrel 2 and enables to use a rear knock button as an actuating member which is quite usual for users, instead of a more sophisticated actuation member which may be less intuitive for the users.

The long tubular piece (23, 32) constituted by the tubular part 23 and the spring member 32, the plunger 22, the ratchet 21 and the pin 24 form a first sub-assembly easy to manipulate if the spring member 32 is oriented downward. This first sub-assembly can be inserted in the rear tubular member 10 of the barrel with the rear end 2*b* thereof oriented downward. Then, the rear knock button 6 is inserted through the rear aperture 5 of the barrel and is snap fitted on the stem 22*b* of the plunger 22. Consequently, the rear knock button 6, the plunger 22, the single tubular piece (23, 32) and the rear tubular member 10 form a non-separable second sub-assembly which can be manipulated in any direction and in particular with the knock button 6 oriented upward to snap fitted on a third sub-assembly comprising the nose-cone 8, the intermediate tubular member 9, the biasing member 16 and the ink cartridge 14 with the nose-cone oriented downward.

To avoid the separation of the ratchet 21 and the adaptor 24 from the first sub-assembly, a removable cooperation between the adaptor 24 and the tubular part 23 could be provided. As best shown on FIG. 7, an annular bead 34 extends radially from the interior surface of the tubular member 23 at its front end 23*a*. Otherwise, the adaptor 24 has a small projection 36 at the rear side of the tubular cylindrical part 24*a*, as visible on FIG. 2.

Therefore, despite the fact that the rear portion of the barrel 10 contains a cushioning device 30 in addition to the actuation mechanism 20, the assembly of the writing instrument is not much more complicated.

Figure 6A:
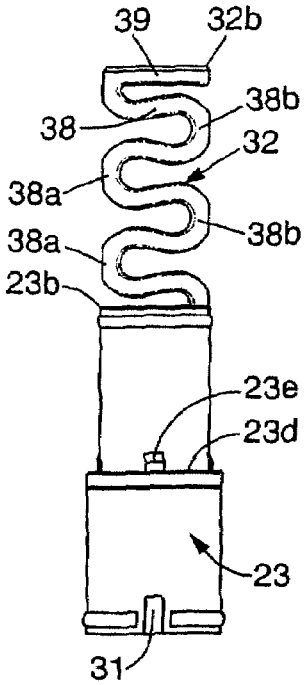
FIGS. 6*a*, 6*b* and 6*c* are right, front and left views respectively of a part belonging to the actuation mechanism and to the cushioning device.
Figure 6B:
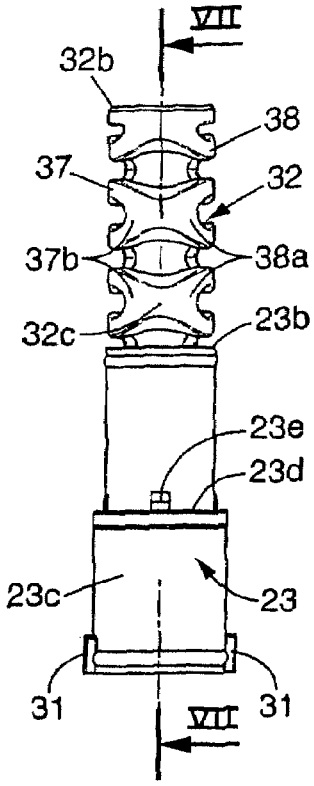
Figure 6C:
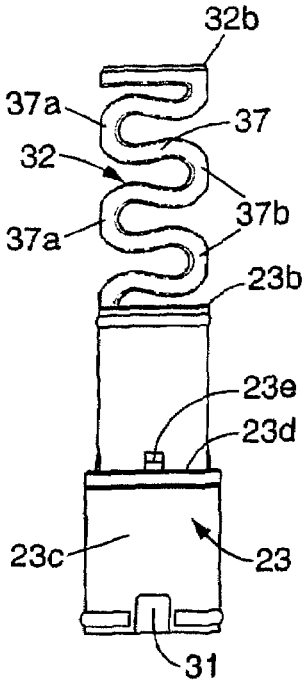
Figure 7:
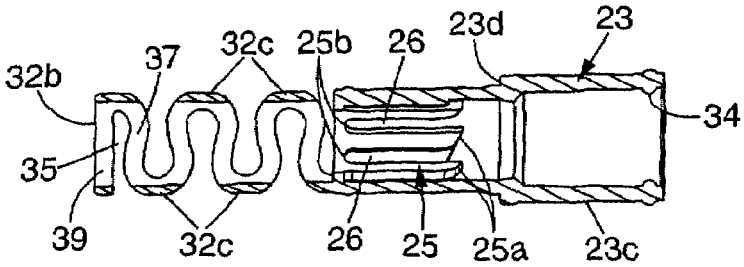
FIG. 7 is a cross-sectional view of the part of FIG. 6*b* along line VII-VII.

As best shown on FIGS. 6 and 7, the spring member 32 has a particular shape which is designed to not transmit any rotational displacement or torque about the central axis Z, when it is compressed axially, to the tubular part 23 integrally formed with it. Indeed, a torque or rotational displacement created by the spring member 32, could be detrimental for the cushioning function if a frictional force is induced between the tubular part 23 and the barrel 2, or detrimental for the functioning of the ratchet-plunger mechanism if an unexpected angular displacement appears between the ratchet 21 and the cam path 25.

The spring member comprises a first and a second wavy portion (37, 38) extending globally in direction of the central axis Z from the rear end 23*b* of the tubular part 23 to a ring 39 forming the rear end 32*b* of the spring member 32. These portions (37, 38) have a shape similar to a band forming waves on both side of its main extension axis like sinusoidal curve along an abscise axis. Consequently, the wavy portions (37, 38) present firsts and seconds curves (37*a*, 38*a*; 37*b*, 38*b*) on the both sides of their extension axis which are parallel to the central axis Z. However, the shape of these wavy portions does not have to correspond to sinusoidal curves; some variations of the amplitude around the extension axis, the radius of the curves and the circumferential extension angle of the curves are possible. This wavy shape avoids creating a torque or an angular displacement around the central axis Z when the spring member is compressed 32. With the same object, each of the wavy portions (37, 38) has an odd number of the firsts and seconds curves (37*a*, 37*b*; 38*a*, 38*b*) equally distributed on both side of the extension axis, and for example four curves in the preferred embodiment.

The wavy portions (37, 38) also have the advantage providing a high resiliency over a significant distance, even if the spring rate thereof is not constant. In addition it should be noted that the continuously curved shape of the wavy portions (37, 38) prevent concentration of mechanical stress in some areas thereof, which would be the case with a spring member having sharp edges. This feature provides important advantages. In deed, it enhances the elastic return of the wavy portions to their initial shape, and also increases their service life.

As it can be seen on FIGS. 6*b* and 7, the first and second wavy portions (37, 38) are arranged in diametrical opposite direction relatively to the central axis Z and arcuated toward this axis to define the through hole 35 extending through the spring member 32. However, the spring member 32 may comprise more than two wavy portions or only one wavy portion, eventually with additional portions having a different shape, to obtain the same advantages.

As best shown on FIG. 6*b*, the first and the second wavy portion are linked together by junction points 32*c* situated at the middle section of two adjacent curves (37*b*, 38*a*) of the first and second wavy portion (37, 38) respectively. This feature reinforces the tubular shape of the spring member 32 and can prevent damages to the wavy portions which have a small cross sectional area, for example during the manufacturing process. The ring 39 at the free end 23*b* of the spring member also reinforces the tubular structure of the spring member 23.

These features also increase the torsional stiffness of the spring member 32 between the ring 39 and the tubular part 23. It could be an advantage if the cushioning device 30 is associated with another kind of actuation mechanism, like a twist mechanism actuated by an actuating member rotatively mounted on the barrel and connected to the free end of the spring member 32 in order to rotate the part 23 integrally formed with it.

As shown on FIG. 2, the cushioning device 30 further comprises an additional spring member 41. This additional spring member 41 is an helical spring made of metal which is arranged between an external shoulder 23*d* oriented rearwardly of the tubular part 23 and an internal shoulder 44 oriented forwardly of the barrel 2.

The additional spring member 41 is compressed in the direction of the longitudinal axis 2 when an excessive pressure is exerted on the writing tip 4. Consequently, the additional spring member 41 creates a cushioning force together with the spring member 32. The provision of two spring members could be advantageous to adapt the cushioning force of the whole cushioning device 30. In fact, the spring member 32 made of plastic material may have a spring rate which is not constant or not high enough for the cushioning function. The additional spring 41 increases the spring rate of the cushioning device 30 and could increase the initial force from which the writing tip 4 retracts, if this additional spring 41 is pre-stressed between the tubular parts 23 on the barrel 2. So, the provision of two different spring members having different spring rate characteristics allows to adjust the spring rate characteristics of the whole cushioning device 30, i.e. the cushioning force according to the rearward displacement of the writing tip, to obtain a particularly efficient cushioning function. For example, the cushioning force could be set as to increase non-linearly, but faster and faster as writing tip moves rearward.

The additional spring 41 is arranged around the rear portion for the tubular part 23. The front end of the spring 41 is slightly press fitted on small protrusions 23*e* situated near the shoulder 23*d* of the tubular part. Thus, the additional spring member 41 is retained on the tubular part 23 and forms a part of the first sub-assembly.

Therefore, the additional spring member is not detrimental for the assembly operations of the writing instrument. It should be noted that the frictional force between the additional spring 41 and the barrel is low because it is a metal/plastic contact and only a fraction of the writing pressure is exerted at this point of contact. Consequently, the additional spring 41 cannot create a significant torque.

It is apparent from the above description for the man skilled in the art that numerous modifications may be made to the embodiment described by way of example. For instance, as mentioned, the actuated mechanism could differ from ratchet-plunger mechanism, the design of the spring member could be modified and the provision of an additional spring member is not compulsory.

The invention claimed is:

1. A writing instrument comprising:

a barrel extending along a central axis between a front end and a rear end provided with a front aperture and a rear aperture;

a writing tip movable through the front aperture between an extended position and a retracted position for which the writing tip is situated within the barrel;

an ink cartridge having a front end connected to the writing tip and a rear end;

an actuating mechanism that includes a plurality of parts for extending and retracting the writing tip upon actuation of an actuation member; and a cushioning device enabling a retraction of the writing tip from the extended position using a spring member and an additional spring member when an excessive writing pressure is exerted on the writing tip by a user, wherein the cushioning device comprises the spring member that is elastically deformable in the central axis direction, wherein the actuating mechanism has a single-piece tubular part being movable relative to the barrel along the central axis, the movable tubular part being connected to the rear end of the ink cartridge and comprising the spring member, wherein the spring member comprises at least one wavy portion extending globally in the direction of the central axis and having at least a first and a second curve distributed on both sides of an extension axis, the at least one wavy portion having a continuously curved shape, wherein the spring member has a free end abutting the barrel toward the barrel rear end and has a through hole extending along the central axis, wherein the cushioning device further comprises the additional spring member that is formed by a metallic helical spring provided around said movable tubular part, between the movable tubular part of the actuating mechanism and the barrel, and wherein a stem extending within the through hole of the spring member, connects the actuating member to the actuating mechanism.

2. The writing instrument according to claim 1, wherein the spring member is designed to prevent transmission of torque around the central axis to the movable tubular part of the actuating mechanism when the spring member is compressed in the direction of the central axis.

3. The writing instrument according to claim 1, wherein the wavy portion has an odd number of curves regularly distributed on both sides of the extension axis.

4. The writing instrument according to claim 3, wherein at least a first and a second wavy portion are provided, the first and second wavy portion being circumferentially arcuated around the central axis to at least partially define the through hole of the spring member.

5. The writing instrument according to claim 4, wherein the first and second wavy portions are linked together by a middle section of two adjacent curves belonging respectively to the first and second wavy portion.

6. The writing instrument according to claim 5, wherein the at least one wavy portion is terminated by a ring at the free end side of the spring member.

7. The writing instrument according to claim 6, wherein the movable tubular part that comprises the spring member has a central axis collinear with the through hole of the spring member.

8. The writing instrument according to claim 1, wherein the spring rate characteristics of the additional spring member are different from the spring rate characteristics of the spring member, these characteristics being determined to adjust cushioning force of the cushioning device.

9. The writing instrument according to claim 8, wherein the additional spring member is fitted on the movable tubular part of the actuating mechanism.

10. The writing instrument according to claim 9, wherein the movable tubular part has at least one cam path cooperating with a rotative part of the actuating mechanism.

11. The writing instrument according to claim 10, wherein the actuating mechanism is a ratchet-plunger type mechanism actuated by a rear knock button.

12. A writing instrument comprising:

a barrel extending along a central axis between a front end and a rear end provided with a front aperture and a rear aperture;

a writing tip movable through the front aperture between an extended position and a retracted position for which the writing tip is situated within the barrel;

an actuating mechanism that includes a plurality of parts for extending and retracting the writing tip upon actuation of an actuation member; and a cushioning device enabling a retraction of the writing tip from the extended position when an excessive writing pressure is exerted on the writing tip by a user, wherein the cushioning device comprises a spring member elastically deformable in the central axis direction, wherein the actuating mechanism has a part being movable relative to the barrel along the central axis, wherein the spring member is integrally formed with the movable part of the actuating mechanism and has a free end abutting the barrel toward the barrel rear end and has a through hole extending along the central axis, wherein the cushioning device further comprises an additional spring member formed by a metallic helical spring provided between the movable part integrally formed with the spring member and the barrel, and wherein a stem extending within the through hole of the spring member, connects the actuating member to the actuating mechanism.

13. The writing instrument according to claim 12, wherein the movable part integrally formed with the spring member is tubular and comprises an external shoulder, the additional spring member being in contact with the external shoulder and retained on the movable part.

14. The writing instrument according to claim 12, comprising an ink cartridge provided with said writing tip, wherein the additional spring member is provided at a distance from the ink cartridge, between the barrel and a peripheral external surface of the movable part integrally formed with the spring member.

15. The writing instrument according to claim 12, wherein the stem is adapted to slide within the through hole of the spring member.

* * * * *